US008678390B2

(12) United States Patent
Guyer

(10) Patent No.: US 8,678,390 B2
(45) Date of Patent: Mar. 25, 2014

(54) CHESS GAME AND METHOD OF PLAY

(76) Inventor: Jim P. Guyer, Jacksonville, FL (US)

( * ) Notice: Subject to any disclaimer, the term of this patent is extended or adjusted under 35 U.S.C. 154(b) by 0 days.

(21) Appl. No.: 13/251,536

(22) Filed: Oct. 3, 2011

(65) Prior Publication Data

US 2012/0025463 A1 Feb. 2, 2012

Related U.S. Application Data

(63) Continuation-in-part of application No. 13/028,754, filed on Feb. 16, 2011, now abandoned.

(60) Provisional application No. 61/333,968, filed on May 12, 2010.

(51) Int. Cl.
*A63F 3/00* (2006.01)

(52) U.S. Cl.
USPC ..... 273/261; 273/255; 273/262

(58) Field of Classification Search
USPC ..... 273/260, 261, 255, 262, 241
See application file for complete search history.

(56) References Cited

U.S. PATENT DOCUMENTS

| | | | | | |
|---|---|---|---|---|---|
| 104,379 | A | * | 6/1870 | Vander Weyde | 273/261 |
| 529,582 | A | | 11/1894 | Beaman | |
| 1,704,819 | A | | 3/1929 | Beaman et al. | |
| 3,724,856 | A | * | 4/1973 | Welch | 273/261 |
| 3,778,065 | A | | 12/1973 | Hale | |
| 3,920,247 | A | | 11/1975 | Jenkins | |
| 3,964,747 | A | * | 6/1976 | Balmforth | 273/261 |
| 4,045,030 | A | * | 8/1977 | Strozewski | 273/260 |
| 4,229,008 | A | | 10/1980 | Jameson | |
| 4,300,768 | A | * | 11/1981 | Wechsler | 273/260 |
| 4,580,787 | A | | 4/1986 | Baker | |
| 4,798,388 | A | | 1/1989 | Nelson | |
| 5,257,787 | A | * | 11/1993 | Miccio | 273/260 |
| 5,908,193 | A | | 6/1999 | Houman | |
| 6,070,871 | A | | 6/2000 | Wilson et al. | |
| D436,139 | S | | 1/2001 | Cummings | |
| 6,170,825 | B1 | | 1/2001 | Pflum | |
| 6,170,826 | B1 | | 1/2001 | Jones | |
| 7,708,279 | B2 | | 5/2010 | Polgar | |
| 2007/0063436 | A1 | * | 3/2007 | Polgar | 273/260 |

* cited by examiner

*Primary Examiner* — Vishu K. Mendiratta
(74) *Attorney, Agent, or Firm* — Charmasson, Buchaa & Leach, LLP

(57) ABSTRACT

A chess-like game has a two-dimensional game board made up of 49 regular hexagonal play spaces assembled into a clustered, stylized diamond shape where seven spaces are arranged side-by-side, contiguously in a central, latitudinal row. Each successive parallel latitudinal row has one less space and its spaces are offset. By the sixth row away from the central row, a single hex space is provided at either end of the board. The color of each space is selected from three available. No space of a first color shares a hex side with a space of a similar color. A reduced set of game pieces are used where each side has one king, one queen, one bishop, one rook, one knight, and five pawns. Each piece has defined legal moves.

6 Claims, 6 Drawing Sheets

CHESS GAME AND METHOD OF PLAY

PRIOR APPLICATION

This is a continuation-in-part of U.S. patent application Ser. No. 13/028,754, filed 2011 Feb. 16 which claims the benefit of U.S. Provisional Patent Application Ser. No. 61/333,968, filed 2010 May 12 both of which are fully incorporated herein by reference.

FIELD OF THE INVENTION

The present invention relates to games, and more specifically to board games similar to chess.

BACKGROUND

The traditional game of chess has existed for centuries and continues to be popular for many reasons including its strategic complexity which can grow with a player's experience level. However, some aspects of traditional chess can be criticized.

For example, the start of the game can often be slow to develop and be perceived as dull to some players who do not invoke opening play strategies, but merely step through a series of choreographed moves in order to get their pieces into playing position.

The movement of some pieces can be confusing to the novice player. For example, the pawn piece has four different sets of moves available. Along with regular pawn movements, the pawn has different moves available for 1st moves, different moves for capturing an opponent's piece, and different moves for when a pawns forward path is obstructed. This requires a player to learn and use four different move sets for a single piece, as well as the conditions that cause them. Further, the Empassant rule regarding pawn moves makes grasping the game even more difficult.

In addition, the rules of pawn movement do not enable restructuring. In other words, pawns are generally unable to restructure once they have come out of formation. Pawns are restricted from moving forward-left or forward-right, except when performing a capture. This potentially detracts from the strategy of being able to reform them. Once Pawns are out of formation, the only way they can be reformed is by capturing an opponent's piece.

A pawn can be redeemed for any major piece, but they are almost always redeemed for additional queens. Allowing multiple queens on the board can unduly upset the balance of power too early in the game. Also, it requires the use of additional queen pieces, or token pieces.

As for the other pieces, the movement of the knight piece can be very complex and difficult to learn for novice players. Even for seasoned players, the available moves for the knight can be difficult to visualize. The bishop piece only has access to one half the spaces on the board, limiting the versatility of the piece.

The end game of chess can be tedious. Many games of Chess slowly wind down with one major piece and a king slowly stepping an opponent's lone king into a corner to be checkmated.

Traditional chess is prone to potentially dissatisfying tie games. Unless a player has a pawn, rook, or queen remaining, there is no way to force a checkmate upon an opponent. When a lone king is not in check, but cannot move, this is considered a stalemate or tie.

Several variations of chess have been proposed. Legan Chess is a chess variant created by L. Legan in 1913. It differs from traditional chess by the position of the board, starting position of the pieces, and pawn movements. A game having hexagonally adjacent spaces was developed by Wladyslaw Glinski in Poland in 1936. Both of these games closely mimic the play of traditional chess and thus include some of the above identified criticisms.

Other variations have been proposed as disclosed in: Beaman, U.S. Pat. No. 1,704,819; Welch, U.S. Pat. No. 3,724,856; Hale et al., U.S. Pat. No. 3,778,065; Jenkins et al., U.S. Pat. No. 3,920,247; Balmforth, U.S. Pat. No. 3,964,747; Baker, U.S. Pat. No. 4,580,787; Wilson et al., U.S. Pat. No. 6,070,871; Jones, U.S. Pat. No. 6,170,826; and, Polgar, U.S. Pat. No. 7,708,279. However, these games still suffer from some potential drawbacks for some players including many of the same drawbacks of traditional chess such as the many sets of moves for the pawn, the pawn redemption rule, difficulty visualizing the moves of the knight, the bishops having access to too few spaces on the board, and the significant probability of ties. In addition, in most of the prior hexagonal chess variants, the king has access to even more spaces than traditional chess, making the king even harder to corner, and causing the end game to be more tedious and difficult to bring to a close.

Therefore, there is a need for a chess game and method of play which addresses one or more of the above problems.

SUMMARY

The principal and secondary objects of the invention are to provide an improved chess game and method of play.

These and other objects are achieved by a chess game having a diamond-shaped game board made up of clustered, hexagonally-shaped play locations or spaces and having a reduced chessmen piece set.

In some embodiments there is provided a chess game implement which comprises: a diamond-shaped game board comprising: an assemblage of clustered, hexagonal, play locations including: a short, median latitudinal first sequence of contiguous, side-by-side locations; a long, median, longitudinal second sequence of similarly colored and spaced-apart, angle-facing locations; two sets of differently colored chessmen, each of said set consisting of: one chessman of a first kind; one chessman of a second kind; one chessman of a third kind; one chessman of a fourth kind; one chessman of a fifth kind; and five chessmen of a sixth kind In some embodiments each of said sequence consists of seven locations.

In some embodiments each of said play locations is a member of one of three specified groups, wherein each of said groups has an appearance distinctive from the other groups.

In some embodiments said distinctive appearance is a particular color.

In some embodiments a first one of said play locations is a first color, and wherein said first one of said play locations is surrounded by six other play locations of a color other than said first color.

In some embodiments each of said other play locations has a hexagonal side in common with said first one of said play locations and two other ones of said other locations.

In some embodiments none of said play locations has a hexagonal side in common with another of said play locations having the same color.

In some embodiments there is provided a method for playing a chess game using the described game board, said method comprising: positioning a first of said sets on a first cluster of ten contiguous locations at a first longitudinal tip of said assemblage; positioning a second of said sets on a second cluster of ten contiguous locations at a second longitudinal tip of said assemblage opposite said first cluster.

In some embodiments the method further comprises: in each of said clusters: placing a chessman of said first kind at the apex; placing chessmen of said second and third kinds each in locations adjoining the location occupied by said chessman of said first kind; placing a chessman of said sixth kind in a location adjoining the locations of said chessmen of said second and third kinds; placing chessmen of said fourth and fifth kinds each in locations adjoiningly astride said chessman of said sixth kind; and placing the remaining four chessmen of said sixth kind side-by-side in locations adjoining the locations occupied by said chessmen of said fourth and fifth kind.

In some embodiments the method further comprises: restricting movement of each chessmen of said sixth kind to the side-by-side forward locations and to the next forward angle-facing location; restricting the movement of a chessman of the fifth kind to any nearest, spaced apart, angle-facing location of the same color or can jump over a first side-by-side hex whether occupied or not, to land on the next linearly side-by-side hex beyond the first hex opposite side; restricting the movement of each chessman of the fourth kind to moving to a side-by-side location or a further distant side-by-side hex in a single direction, so long as none of those hexes are occupied; restricting the movement of each chessman of the third kind to a forward or backward side-by-side location and to any angle-facing or in-line angle-facing locations, so long as any nearer angle-facing location in the same direction is unoccupied; restricting the movement of each chessman of the second kind to the combined movements of the chessmen of the third and fourth kinds; and restricting the movement of each chessman of the first kind to a side-by-side location.

The content of the original claims is incorporated herein by reference as summarizing features in one or more exemplary embodiments.

DESCRIPTION OF THE EXEMPLARY EMBODIMENTS

Figure 1:
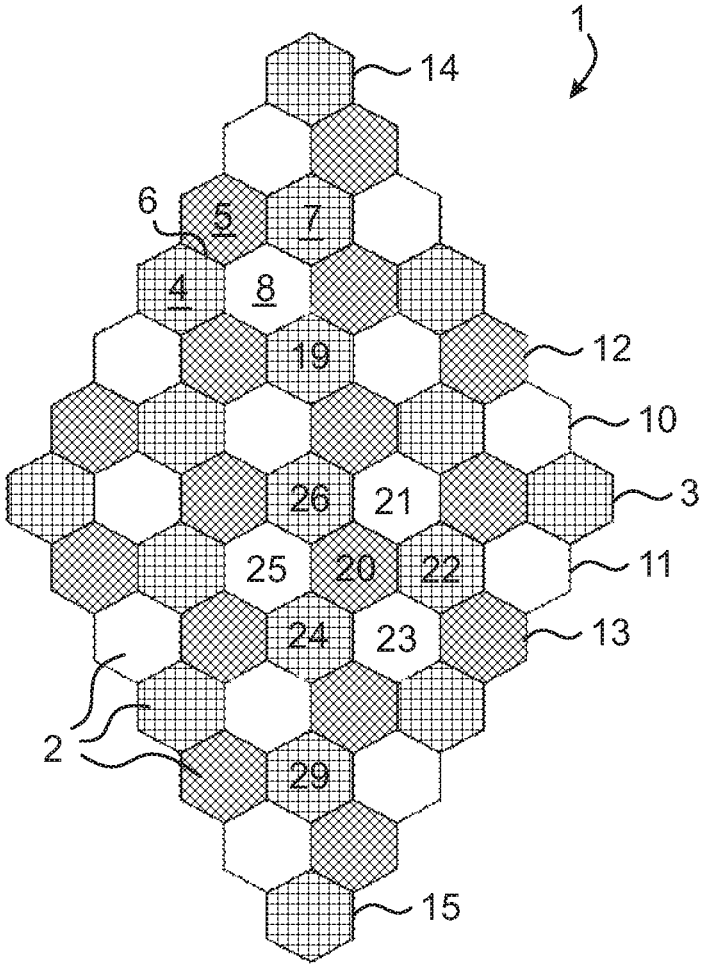
FIG. 1 is a diagrammatic plan view of a game board according to an embodiment of the invention.

Referring now to the drawing, there is shown in FIG. 1 a two-dimensional game board 1 made up of 49 regular hexagonal play locations or spaces 2 assembled into a clustered, stylized diamond shape where seven spaces are arranged side-by-side, contiguously in a central, linear, horizontal, latitudinal row 3 where each space borders a laterally located space along a common hexagonal side. In this specification the term "adjoining" in reference to two hexagonal spaces means that the two spaces 4,5 share a common hexagonal side 6. The term "adjacent to" in reference to two hexagonal spaces means that the two spaces 4,7 do not share a common hexagonal side but rather angle-face one another and are spaced apart by a pair of adjoining spaces 5,8.

Straddling the central row 3 are parallel rows 10,11 where each row that is more longitudinally distant from the central row, the number of spaces is reduced by one. In other words, the two rows 10,11 immediately straddling and parallelly adjacent to the central row each have six spaces. The rows 12,13 straddling and parallelly adjacent to these rows each have five spaces and so on until one-space rows 14,15 exist most separated from the central row at opposite longitudinal ends.

Each of the spaces is further defined by being a member of one of three distinctive specific groups of similarly appearing spaces. This grouping can be based on color or some other clearly visible indication. This is analogous to the two contrasting colors of squares in traditional chess. Where traditional chess has a checkerboard arrangement of squares where each square is either of the black color or the white color, the present embodiment has hex spaces where each hex space is one of three possible colors, namely, black, white and red for example. In the drawing, black is indicated by the finer, 45-degree angled cross-hatch pattern while red is indicated by the coarser vertically oriented cross-hatch pattern.

As shown in FIG. 1, the pattern of colored spaces in the game board is arranged so that no space adjoins a space of a similar color. In this way for example, space 20 is surrounded by six adjoining spaces 21-26. Because none of these spaces can adjoin the same color, space 20 is surrounded angularly by an alternating succession of different colors. Thus if space 20 is black, space 21 is red, space 22 is white, space 23 is red, and so on.

Thus, the above described layout of spaces and patterning of colors results in the board shown in FIG. 1, and that longitudinally there is formed a long, median, second sequence of similarly colored and spaced-apart, angle-facing spaces. This sequence can be seen as the vertical column of spaces formed in line between the two single-space rows 14,15, and which includes spaces 7, 19, 26, 24, and 29. These spaces are adjacently spaced apart and of the same color. In other words, space 22 has a point or angle 27 facing a point or angle 28 of space 29.

Figure 2:
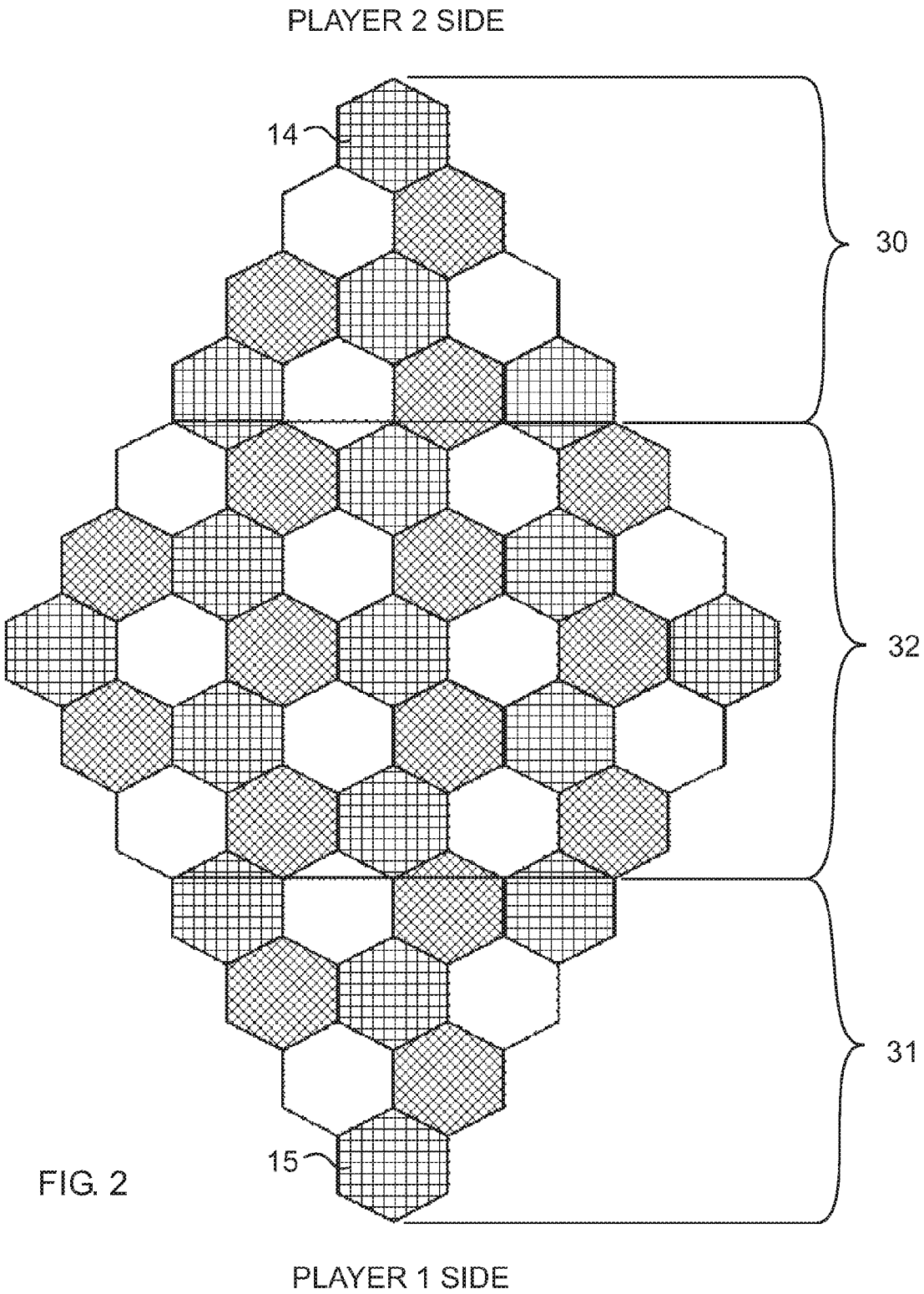
FIG. 2 is a diagrammatic plan view of a game board showing the three setup section.
Figure 3:
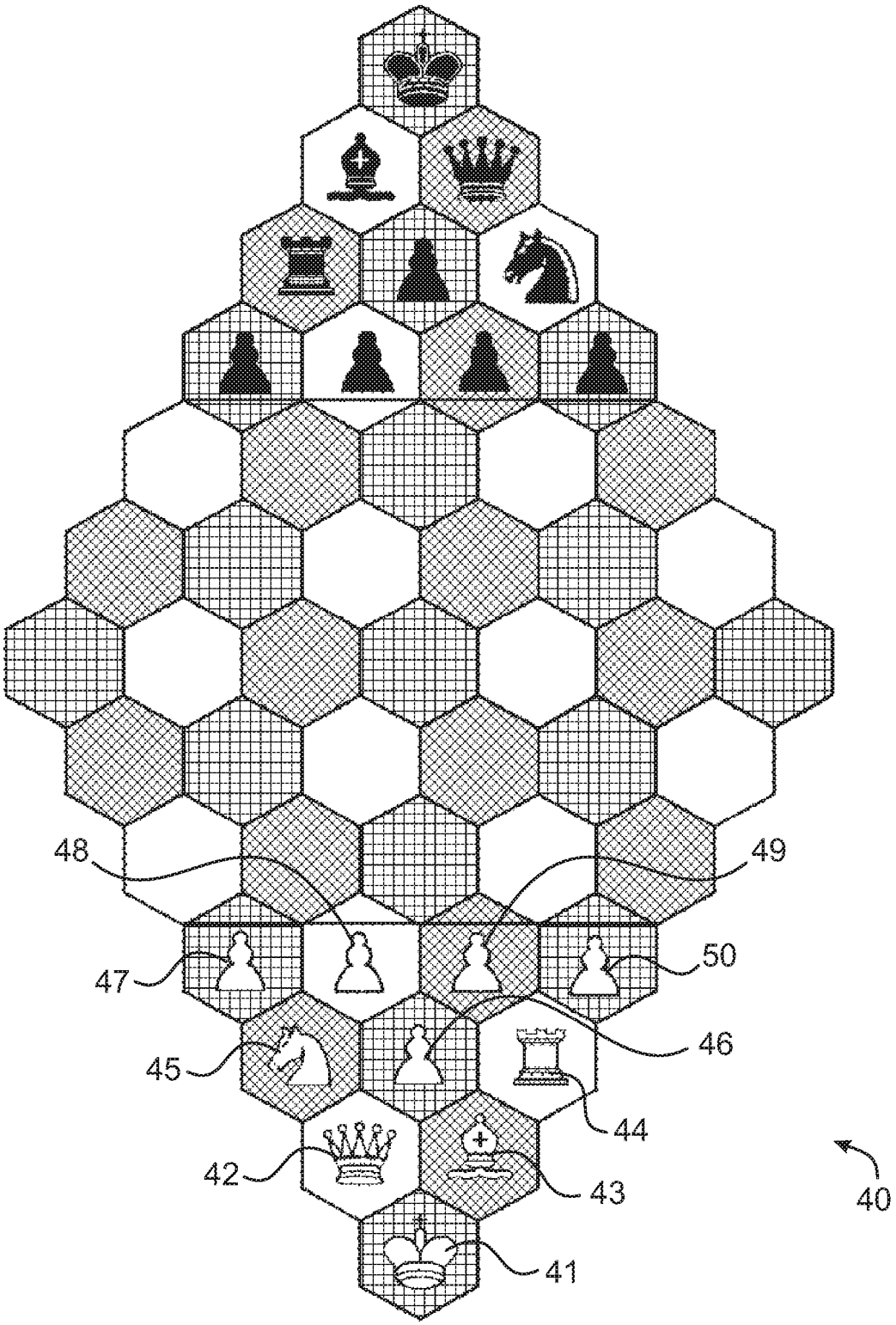
FIG. 3 is a diagrammatic plan view of a game board showing the game piece in the pregame setup configuration.

Referring now to FIG. 2, the game board is oriented so that the single space latitudinal rows 14,15 are in front of each opposing player. The board is generally divided into three sections. There is a ten hex space home area triangle section 30,31 for each player and a twenty-nine space common area 32.

Each side has the same specific number of game pieces or chessmen 40. Each side has one king 41, one queen 42, one bishop 43, one rook 44, one knight 45, and five pawns 46-50. Thus, each player is allowed only one major piece.

The start positions for the pieces are the same for each side as follows: The king 41 occupies the first, one-space row closest to the player. The next further away two-space horizontal row is occupied by the queen 42 on the left and the bishop 43 on the right. The next further away three-space row is occupied by the knight 45 on the left, the rook 44 on the right, and a pawn 46 in the center. The next further away four-space row 54 is occupied by four pawns 47-50. It can be appreciated that unlike traditional chess, each player's queen is on their left hand side.

In this specification the following types of movements are defined.

Figure 4:
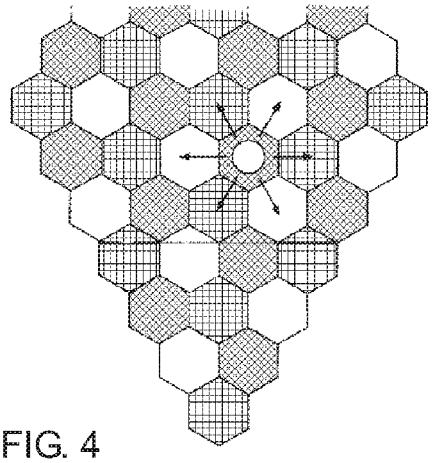
FIG. 4 is a diagrammatic partial plan view of a game board showing an adjoining move.

FIG. 4 shows an "adjoining move" which includes any move to and stopping on an adjoining hex. As stated above, an adjoining hex is any one of six hexes surrounding the current hex in a side-by-side manner, where each adjoining hex has a side in common with the current hex.

Figure 5:
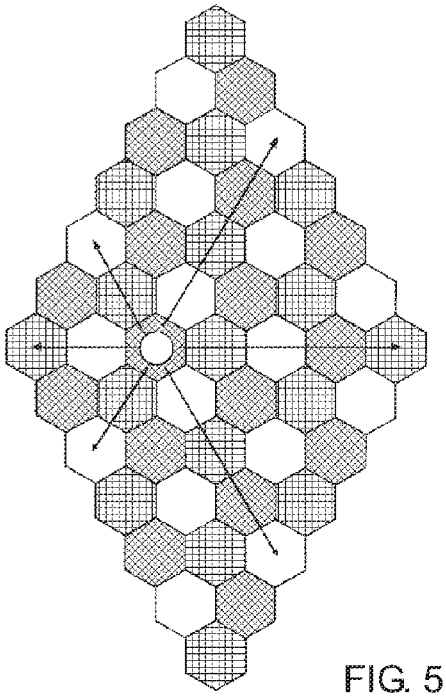
FIG. 5 is a diagrammatic plan view of a game board showing a perpendicular move.

FIG. 5 shows a "perpendicular move" which includes any move to any adjoining hex as well as any available hex radiating outward from an adjoining hex in a single direction.

Figure 6:
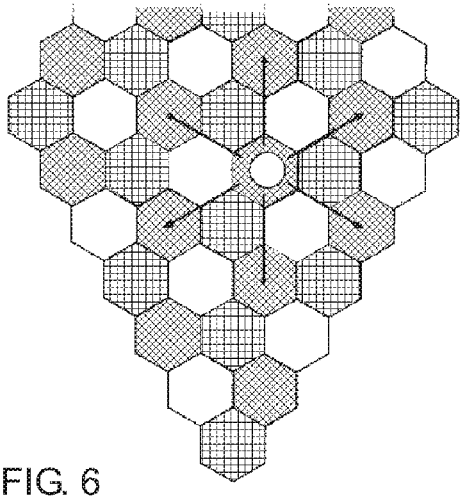
FIG. 6 is a diagrammatic partial plan view of a game board showing an adjacent move.

FIG. 6 shows an "adjacent move" which includes a move to any one of six like colored hexes that are near one of the six points of the current hex. In other words and adjacent move is to any nearest angle-facing hex.

Figure 7:
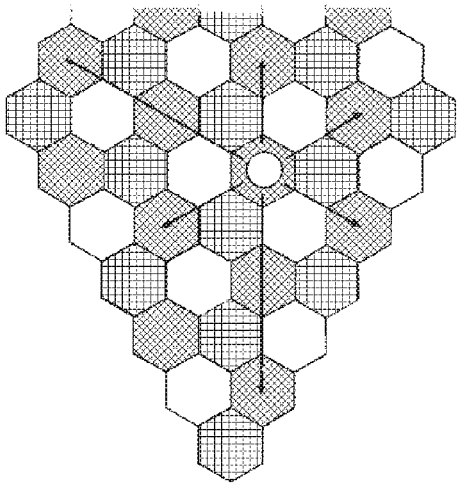
FIG. 7 is a diagrammatic partial plan view of a game board showing an orthogonal moves.

FIG. 7 shows an "orthogonal move" which includes any move to any adjacent, angle-facing hex as well as any available like colored hex radiating outward from an adjacent hex in the same direction; such hexes can be referred to as in-line, angle-facing hexes.

Figure 8:
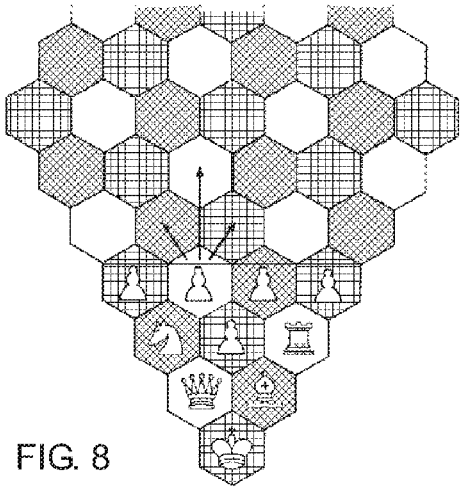
FIG. 8 is a diagrammatic partial plan view of a game board showing pawn moves.

The allowed movement of the pieces is described as follows:

FIG. 8 shows the moves available to the Pawn piece. Pawns move and capture in the same way, by moving to the adjoining hex forward-left, the adjoining hex to the forward-right, or by moving orthogonally to the adjacent hex directly forward. If a pawn lands on a space in the opposing player's home triangle it may be immediately redeemed for any lost piece and moved as that piece on the next turn. If the player has not lost any pieces or, opts not to redeem, the pawn can later be redeemed at the start on any of the controller's turns, prior to the move. This can be an especially powerful tactic for the owner of a redeemable pawn when a plurality of the owner's pieces have been captured. It allows the owner to potentially guard the all spaces which would be within movement of all his captured pieces, at least until redemption occurs. However, because this power can make potential king checks very complex, it can be a rule that on any given turn a pawn must first be moved as a pawn and then redeemed at the end of the turn for a captured piece to be used on a subsequent turn. Thus, for example, if a player has lost only a knight or bishop, it may be more advantageous to save a pawn redemption for when it is moved again on a later turn as an assurance of being able to quickly recover from the loss of a more important piece such as a queen or rook.

Figure 9:
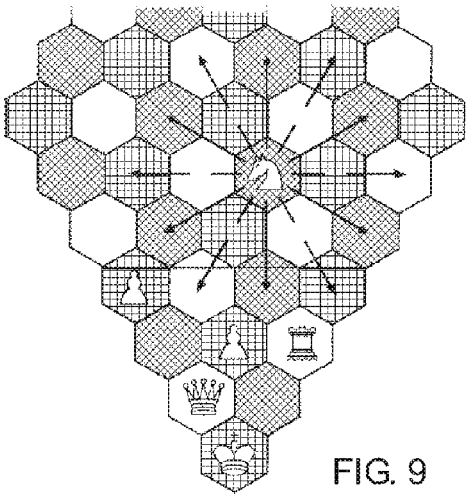
FIG. 9 is a diagrammatic partial plan view of a game board showing knight moves.

FIG. 9 shows the moves available to the Knight piece. The Knight can jump over an adjoining hex, whether occupied or not, to land on the next linearly adjoining hex beyond its opposite side, or it can move orthogonally to an adjacent space. The knight is the only piece that can jump over another piece.

Figure 10:
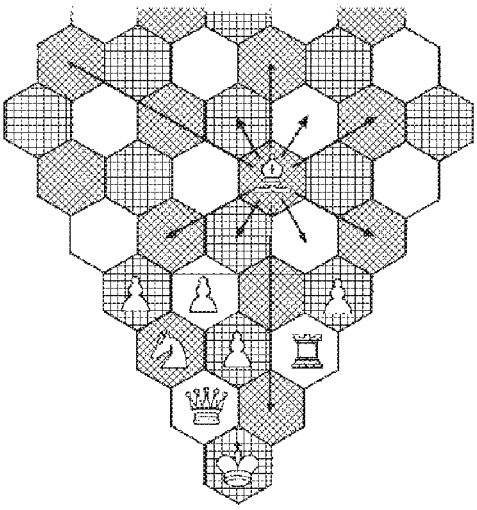
FIG. 10 is a diagrammatic partial plan view of a game board showing bishop moves.

FIG. 10 shows the moves available to the Bishop piece. The bishop can move one space to the adjoining hex forward-left, the adjoining hex forward-right, the adjoining hex rear-left, the adjoining hex rear-right, or can move any number of spaces orthogonally so long as a preceding space is unoccupied. In this way the bishop can take a turn to change color as it were. Optionally, the rules can be adapted to allow the bishop to move laterally to an adjoining hex space.

Figure 11:
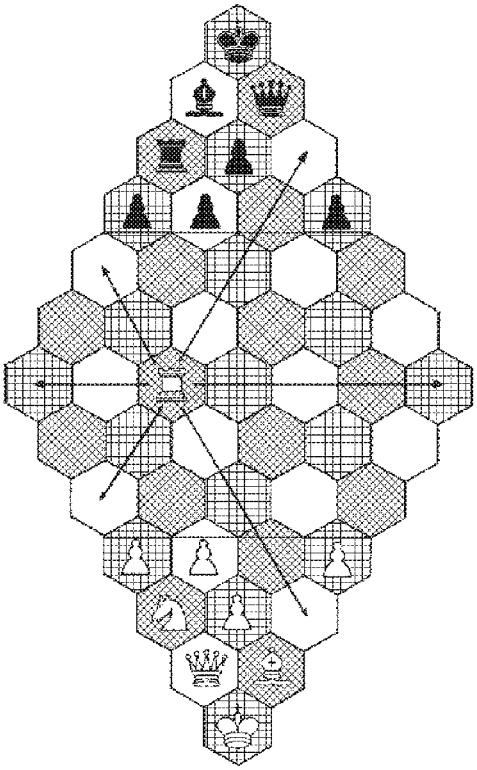
FIG. 11 is a diagrammatic plan view of a game board showing rook moves.

FIG. 11 shows the moves available to the Rook piece. The rook can move any number of spaces, starting from an adjoining hex or any number of moves perpendicularly so long as it does not pass through an occupied space.

Figure 12:
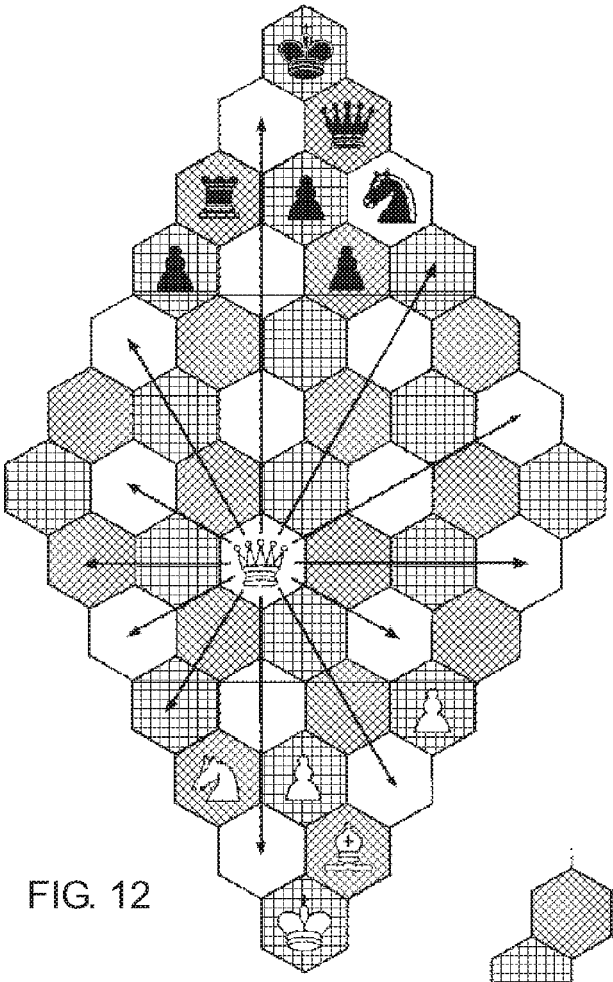
FIG. 12 is a diagrammatic plan view of a game board showing queen moves.

FIG. 12 shows the moves available to the Queen piece. The queen has all the moves of both the bishop and rook. The only move a queen cannot emulate is the knight's ability to jump over another piece.

Figure 13:
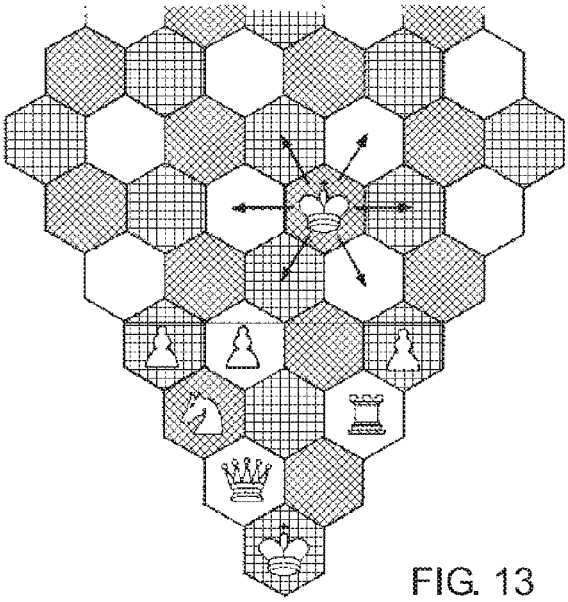
FIG. 13 is a diagrammatic partial plan view of a game board showing king moves.

FIG. 13 shows the moves available to the King piece. The King is only able to move to an adjoining hex. It cannot move orthogonally to an adjacent hex.

In some game situations these moves can be further restricted. For example, if a player cannot move out of check, the player is check-mated and has lost. If a player is on turn and is not in check but cannot move without putting the king in check, the player is mated and has lost the game. In this way, many of the ties of traditional chess can be avoided. If the two kings are the only pieces left on the board, the game is a draw.

It can be appreciated that unlike traditional chess, the pawn piece moves are not determined on whether or not the pawn is capturing an opponent piece. Pawn redemption can occur immediately after moving a pawn a space in the opponents home triangle section. Furthermore, the pawn can only be redeemed for one of those major pieces currently captured by the opponent. Thus no additional game pieces or tokens are necessary.

While the exemplary embodiments of the invention have been described, modifications can be made and other embodiments may be devised without departing from the spirit of the invention and the scope of the appended claims.

What is claimed is:

1. A chess game implement which comprises:

a diamond-shaped game board having pair of opposite lateral tips and a pair of opposite longitudinal tips, said board consisting of:

an assemblage of clustered, hexagonal, play locations including:

a short, median latitudinal first sequence of contiguous, side-by-side locations, beginning at a first one of said opposite lateral tips and ending at a second one of said opposite lateral tips;

a long, median, longitudinal second sequence of similarly colored and spaced-apart, angle-facing locations, beginning at a first one of said opposite longitudinal tips and ending at a second one of said opposite longitudinal tips;

wherein each of said sequence consists of seven locations;

two sets of differently colored chessmen, each of said sets consisting of:

one chessman of a first kind;

one chessman of a second kind;

one chessman of a third kind;

one chessman of a fourth kind;

one chessman of a fifth kind; and five chessmen of a sixth kind; and, wherein a first one of said sets is positioned on a first triangular cluster of ten contiguous locations at said first one of said opposite longitudinal tips; and, wherein a second one of said sets is positioned on a second triangular cluster of ten contiguous locations at said second one of said opposite longitudinal tips: and, a redeemable one of said chessman of said sixth kind being redeemable for a captured one of said set of chessman when said redeemable one has moved onto a redeeming location in an opposing one of said triangular clusters.

2. The implement of claim 1, wherein each of said play locations is a member of one of three specified groups, wherein each of said groups has an appearance distinctive from the other groups.

3. The implement of claim 2, wherein said distinctive appearance is a particular color.

4. The implement of claim 3, a first one of said play locations is a first color, and wherein said first one of said play locations is surrounded by six other play locations of a color other than said first color.

5. The implement of claim 4, wherein each of said other play locations has a hexagonal side in common with said first one of said play locations and two other ones of said other locations.

6. The implement of claim 5, wherein none of said play locations has a hexagonal side in common with another of said play locations having the same color.

* * * * *